US009868188B2

(12) United States Patent
Merrick

(10) Patent No.: US 9,868,188 B2
(45) **Date of Patent: *Jan. 16, 2018**

(54) FLIP SOCKET NUT REMOVAL TOOL

(71) Applicant: ToolTech, LLC, Phoenix, AZ (US)

(72) Inventor: Jake Merrick, Hinton, OK (US)

(73) Assignee: ToolTech, LLC, Phoenix, AZ (US)

( * ) Notice: Subject to any disclaimer, the term of this patent is extended or adjusted under 35 U.S.C. 154(b) by 251 days.

This patent is subject to a terminal disclaimer.

(21) Appl. No.: 14/825,959

(22) Filed: Aug. 13, 2015

(65) Prior Publication Data

US 2015/0343613 A1 Dec. 3, 2015

Related U.S. Application Data

(63) Continuation of application No. 13/767,746, filed on Feb. 14, 2013, now Pat. No. 9,138,873.

(51) Int. Cl.

| | |
|---|---|
| ***B25B 13/44*** | (2006.01) |
| ***B25B 13/46*** | (2006.01) |
| ***B25B 23/00*** | (2006.01) |

(52) U.S. Cl.

CPC ..... *B25B 13/44* (2013.01); *B25B 13/461* (2013.01); *B25B 23/0035* (2013.01)

(58) Field of Classification Search

CPC .... B25B 13/44; B25B 13/461; B25B 23/0035
See application file for complete search history.

(56) References Cited

U.S. PATENT DOCUMENTS

| | | | |
|---|---|---|---|
| 877,773 | A | 1/1908 | Holm |
| 1,740,377 | A | 12/1929 | Snyder et al. |
| 2,027,534 | A | 1/1936 | Ingersoll |
| 2,069,527 | A | 2/1937 | Kirkland |
| 2,248,695 | A | 7/1941 | Bradshaw |
| 2,397,216 | A | 3/1946 | Stellin |
| 2,445,525 | A | 7/1948 | Gulden |
| 2,550,929 | A | 5/1951 | Kelser |
| 2,580,247 | A | 12/1951 | Secondi et al. |
| 2,684,526 | A | 7/1954 | Hoover |
| 2,884,826 | A | 5/1959 | Bruhn |

(Continued)

FOREIGN PATENT DOCUMENTS

| | | |
|---|---|---|
| JP | 07164341 | 6/1995 |
| JP | 2011104707 A | 6/2011 |

OTHER PUBLICATIONS

U.S. Appl. No. 13/767,746, filed Feb. 14, 2013 entitled Flip Socket Nut Removal Tool.

(Continued)

*Primary Examiner* — David B Thomas

(74) *Attorney, Agent, or Firm* — Bracewell LLP; James E. Bradley

(57) ABSTRACT

A tool for removing a first nut and a differently sized second nut includes a housing, a first cage and a second cage, and a first canted coil spring and a second canted coil spring. The illustrative housing has a top surface, a first interior sidewall, a bottom surface and a second interior sidewall. Each illustrative interior sidewall includes a lobed cam and a groove. Each cage includes jaws that grip the respective not and each cage also includes a groove. The canted coil springs are disposed in the grooves corresponding to the cage and the housing.

20 Claims, 8 Drawing Sheets

(56) References Cited

U.S. PATENT DOCUMENTS

| | | | | |
|---|---|---|---|---|
| 3,122,963 | A | 3/1964 | Borgeson | |
| 4,235,134 | A | 11/1980 | McLendon | |
| 4,651,596 | A | 3/1987 | Rachanski | |
| 4,724,730 | A | 2/1988 | Mader et al. | |
| 4,899,626 | A | 2/1990 | Lymburner | |
| 4,947,712 | A | 8/1990 | Brosnan | |
| 5,048,379 | A | 9/1991 | Gramera et al. | |
| 5,251,515 | A | 10/1993 | Merrick | |
| 5,299,473 | A | 4/1994 | Weber et al. | |
| 5,305,670 | A | 4/1994 | Fossella et al. | |
| 5,315,902 | A | 5/1994 | Ragland et al. | |
| 5,349,887 | A | 9/1994 | Suwa | |
| 5,533,426 | A | 7/1996 | Morales | |
| 5,957,645 | A | 9/1999 | Stacy | |
| 5,996,446 | A | 12/1999 | Lee | |
| 6,134,992 | A | 10/2000 | Perkins | |
| 6,748,828 | B2 | 6/2004 | Bollinger | |
| 7,334,506 | B2 | 2/2008 | Hui | |
| 7,437,975 | B1 | 10/2008 | Anfrasio | |
| 8,182,187 | B2 | 5/2012 | Siong | |
| 8,955,414 | B2 | 2/2015 | Merrick | |
| 8,997,608 | B2 | 4/2015 | Merrick | |
| 9,132,531 | B2 * | 9/2015 | Merrick | B25B 13/50 |
| 9,138,873 | B2 * | 9/2015 | Merrick | B25B 13/44 |
| 9,278,434 | B2 * | 3/2016 | Merrick | B25B 13/54 |
| 9,662,775 | B2 * | 5/2017 | Merrick | B25B 23/103 |
| 2006/0150778 | A1 | 7/2006 | Hennessey et al. | |
| 2008/0016987 | A1 | 1/2008 | Schultz | |
| 2014/0224074 | A1 * | 8/2014 | Merrick | B25B 13/50 81/52 |
| 2014/0224075 | A1 * | 8/2014 | Merrick | B25B 13/44 81/52 |
| 2014/0224076 | A1 * | 8/2014 | Merrick | B25B 13/5016 81/53.2 |
| 2014/0224084 | A1 * | 8/2014 | Merrick | B25B 27/18 81/443 |
| 2014/0224085 | A1 | 8/2014 | Merrick | |
| 2015/0183095 | A1 * | 7/2015 | Merrick | B25B 13/50 81/128 |
| 2015/0343615 | A1 * | 12/2015 | Merrick | B25B 13/54 81/446 |
| 2015/0343624 | A1 * | 12/2015 | Merrick | B25B 27/18 81/446 |

OTHER PUBLICATIONS

U.S. Appl. No. 13/767,771, filed Feb. 14, 2013 entitled Socket Fastener Removal Tool.

U.S. Appl. No. 14/584,839, filed Dec. 29, 2014 entitled Nut Removal Tool.

U.S. Appl. No. 13/767,758, filed Feb. 14, 2013 entitled Dutchman Fastener Removal Tool.

U.S. Appl. No. 14/824,173, filed Aug. 12, 2015 entitled Dutchman Fastener Removal Tool.

International Search Report with Written Opinion issued in related PCT Application No. PCT/US2014/016485, dated May 26, 2014—10 pages.

* cited by examiner

FLIP SOCKET NUT REMOVAL TOOL

CROSS-REFERENCE

The present patent application is a continuation of Ser. No. 13/767,746, filed Feb. 14, 2013.

FIELD

The invention is a flip socket nut removal tool. More particularly, this invention relates to a tool for the removing a first nut and a second nut, in which the first nut is a different size than the second nut.

BACKGROUND

A nut is a type of fastener with a threaded hole that interfaces with a mating bolt. Bolts are a type of fastener with a threaded cylindrical barrel on one end of the fastener that mates with a complementary thread in the nut. The nut and mating bolt are kept together by a combination of thread friction, a slight stretch of the bolt, and compression of the parts. The most common shape for a nut fastener is hexagonal, because six sides give a good granularity of angles for a tool to approach from. However, the earners are vulnerable to being rounded off.

Nuts are traditionally removed using hand wrenches or screwdrivers by applying a counterclockwise rotational force to the head of the fastener. However, where the head of the fastener has been rounded, damaged or broken off through the application of excessive torque, or where the fastener has been corroded, it is very difficult and time consuming to remove the nut and bolt.

A further complication of nut removal using manual tools is that, where the nut is very large, such as those used in oil production, manual removal of such damaged nuts presents danger to the operator, or removal is impossible because of the degree of torque required for removal.

One type of device accomplishes nut removal by sawing off the nut, or by using a blow torch to cut the nut off of the bolt. However, these methods of nut removal result in damage to the nut and/or the bolt. This problem may be solved with devices which either drill the nut, or cut into the nut, so that torque can be applied to the nut for removal. However, these devices also result in further stripping and rounding of the nut.

Devices for the removal of large nuts using an air impact tool exist; however, in one such device, a cartridge having many small parts is used to apply torque to the damaged nut and these multiple small parts of the cartridge, such as multiple helical springs, studs and screws holding gripping jaws together are prone to breakage.

A further complication is that cartridges and other parts are held within a cylindrical housing using a retaining ring or clip. The retaining ring or clip is prone to breakage, resulting in a damaged and useless tool.

Another complication of not removal using a hand-powered tool is side loading, or the mechanical binding of threaded surfaces against each other. When side loading occurs, heat builds up due to friction between the threaded surfaces, creating a gall which is carried through the housing, tearing out the threads, and impeding nut removal.

Yet another complication is "chattering," where the tool does not perfectly conform to the size of the fastener. When rotative force is applied using an air impact tool, the removing tool "chatters" over the damaged comers of the fastener, further stripping the fastener or damaging the tool interface with the fastener, and causing 'radii' to form on the end of the tool.

A further problem is presented with a single device for nut removal because the device is limited in the size of nuts which can be removed with a single tool; that is, different-sized nuts cannot be removed with the same tool because the nut heads cannot fit within the tool.

The use oft set of tools having a multiplicity of sizes to conform to different nut head sizes could solve problem of imperfect conformance between removal tool and nut size. However, regardless of the size, the result is chattering from an imperfect size conformance; thus, stripping of the out thread occurs.

Further, the use of a set of tools having a multiplicity of sizes to conform to nut sizes presents another complication. If there exists a multiplicity of removal tool sizes in a set, the loss of one of the tools results in a useless tool set.

While the use of an air impact tool may remove much of the operator danger associated with hand wrenches, the use of an air impact tool presents a further problem. That is, the air impact tool, itself, creates a shock upon impact with the nut. When using sockets attached to air impact tools for nut removal this shock impact can damage both the nut and adjacent surfaces, such as the rim of a tire that houses the nut attaching the tire to an axle on an automobile.

A further complication of some devices is that these ridged teeth on the gripping surface of the jaws which strip the nut heads having a set number of faces, i.e., a hexagonal nut head.

Another complication is the thickness of the housing of the socket containing the jaws of the nut removal tool. A housing which is too thick can cause damage to the fixture which the nut is screwed into, such as the rim of a tire. With the use of an impact wrench attached to a thick housing for the removal of such a nut, tire rims are frequently damaged during removal for tire mounting and balancing.

It would thus be desirable to have a nut removal tool that conforms to the size and shape of a multiplicity of nut heads, where the jaws of the tool comprise one piece, rather than a multiplicity of smaller pieces which can be easily lost or damaged, and where the jaws are retained within a this housing through a shock-absorbing canted coil spring.

SUMMARY

An apparatus for removing a first nut and a differently sized second nut is described. The illustrative apparatus includes a housing, a first cage and a second cage, and a first canted coil spring and a second canted coil spring. The illustrative housing has a top surface, a first interior sidewall, a bottom surface and a second interior sidewall. The illustrative first interior sidewall defines an orifice that extends from the top surface to a first lip. The first interior sidewall includes a first three-lobed cam and a first groove. Each illustrative lobe has a first lobe center line, a first counterclockwise cam inner surface on one side of the first lobe center line, and a first clockwise cam inner surface on the opposite side of the first lobe-center line. The illustrative first groove is disposed between the top surface and the first lip. The housing also includes an enclosed channel that extends from the first lip to a second lip.

The illustrative second interior sidewall of the housing defines an orifice that extends from the bottom surface to the second lip. The second interior sidewall includes an illustrative second three-lobed cam and a second groove. Each lobe has a second lobe centerline, a second counterclockwise cam inner surface on one side of the second lobe centerline, and a second clockwise cam inner surface on the opposite side of the second lobe centerline. The second groove is disposed between the bottom surface and the second lip.

The illustrative first cage has a first top surface, a first bottom portion ending in a first terminus and a first groove disposed between the first jaw top surface and the first terminus. The first cage includes three jaws. Each jaw includes a first jaw outer cam surface, a first jaw centerline, and a first jaw inner cam surface. The first jaw outer cam surface interfaces with the first cam inner surface corresponding to the first interior sidewall. The first jaw inner cam surface interfaces with the head of the first nut. The first jaw inner cam surface includes a first counterclockwise cam inner surface on one side of the first jaw centerline, and a first clockwise cam inner surface on the opposite side of the first jaw centerline.

The illustrative second cage has a second top surface, a second bottom portion ending in a terminus and a second groove disposed between the second jaw top surface and the second terminus. The second cage includes three jaws. Each jaw includes a second jaw outer cam surface, a second jaw centerline, and a second jaw inner cam surface. The second jaw outer cam surface interfaces with the second cam inner surface corresponding to the second interior sidewall. The second jaw inner cam surface interfaces with the head of a second nut having a different size than the head of the first nut. The second jaw inner cam surface includes a second counterclockwise cam inner surface on one side of the second jaw centerline, and a second clockwise cam inner surface on the opposite side of the second jaw centerline.

The illustrative first canted coil spring is received by the first groove of the first interior sidewall and the first groove of the first cage. The first canted coil spring rotatably couples the first cage to the housing. During nut removal using the first cage, the housing rotates counterclockwise relative to the first cage. The first cage rotates counterclockwise to engage the first out, and the first cage interfaces with the first interior sidewall. The first canted coil spring operates within a constant deflection range, when an axial load is applied by the housing and the first cage.

The illustrative second canted coil spring is received by the second groove of the second interior sidewall and the second groove of the second cage. The second canted coil spring rotatably couples the second cage to the housing. During nut removal using the second cage, the housing rotates counterclockwise relative to the second cage. The second cage rotates counterclockwise to engage the second nut, and the second cage interlaces with the second interior sidewalk lire second canted coil spring operates within a constant deflection range, when an axial load is applied by the housing and the second cage.

In one embodiment, the canted coil spring has the coils earned in a clockwise direction. In another embodiment, the canted coil spring has the coils canted in a counterclockwise direction.

In the illustrative embodiment, the lobe center line for each lobe is 120° apart, each lobe occupies a 120° arc, the counterclockwise cam interface has a 60° arc and the clockwise cam interface has a 60° arc. In the illustrative embodiment, each lobe is substantially semi-circular.

In a further illustrative embodiment, the jaw centerlines for each jaw are 120° apart, and each jaw outer cam surface occupies a 60° arc.

In the illustrative embodiment, the jaw outer cam surface is configured to engage with the counterclockwise cam interface when a counterclockwise force is applied to the housing relative to the cage. In a further embodiment, the jaw outer cam surface is configured to engage with the clockwise cam interface when a clockwise force relative to the cage is applied to the housing.

In the illustrative embodiment, the jaw inner counterclockwise cam surface is configured to engage with three surfaces of the head of a hexagonal nut when a counterclockwise force relative to the cage is applied to the jaw outer cam surface. In a further embodiment, the jaw inner clockwise cam surface is configured to engage with the three surfaces of the head of a hexagonal nut when a clockwise force relative to the cage is applied to the jaw outer cam surface.

In another illustrative embodiment, an elastomeric or elastic component is configured to join the plurality of jaws.

DESCRIPTION

Figure 1A:
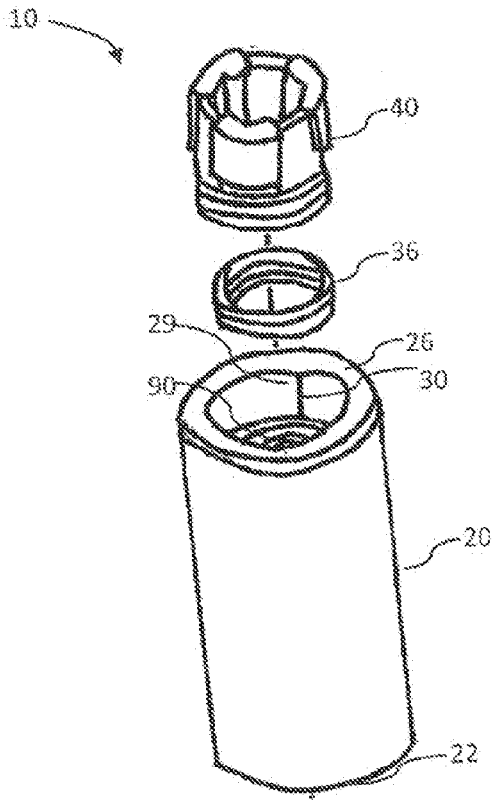
FIG. 1A shows an isometric view of the top portion of an illustrative flip socket nut removal tool.
Figure 1C:
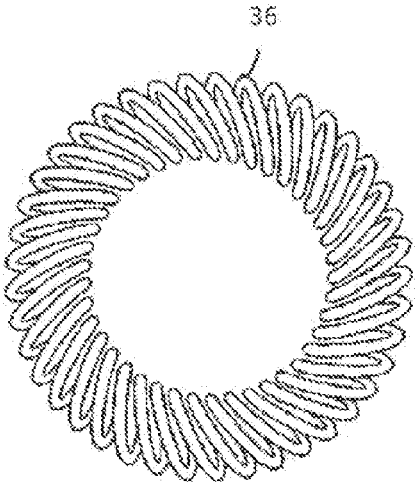
FIG. 1C shows an exploded view of a canted coil spring.

Persons of ordinary skill in the art will realize that the following description is illustrative and not in any way limiting. Other embodiments of the claimed subject matter will readily suggest themselves to such skilled persons having the benefit of this disclosure. It shall be appreciated by those of ordinary skill in the art that the apparatus and systems described herein may vary as to configuration and as to details. Additionally, the methods may vary as to details, order of the actions or other variations without departing from the illustrative method disclosed herein.

It is to be understood that the detailed description of illustrative embodiments provided for illustrative purposes.

The scope of the claims is not limited to these specific embodiments or examples. Various structural limitations, elements, details, and uses can differ from those just described, or be expanded on or implemented using technologies not vet commercially viable, and yet still be within the inventive concepts of the present disclosure. The scope of the invention is determined by the following claims and their legal equivalents.

The flip socket nut removal tool described herein is used for the removal of a differently sized nut from a bolt using the same tool. Generally, the removal of the nut employs a rotary tool such as an impact wrench. Alternatively, other tools that provide needed torque may also be used. By way of example and not of limitation, the nut removal tool described herein may be used to remove nuts that are deployed in oil production, or power generation.

The flip socket nut removal tool described herein can be used in the automotive or tire change industry. Unlike the Nut Removal Tool having the same named inventor and incorporated by reference herein, the flip socket nut removal tool can be used to remove smaller nuts, such as lug nuts on after-market aluminum wheels that are used for securing a wheel to a vehicle. For such wheels, the socket needs to be very thin while still functional. For example, the a metric lug nut assembly may be steed for 17 mm, 19 mm, 21 mm and 23 mm sockets. Additionally, the lug nut assembly may include ⅜"×7/16", ½"×9/16", ⅝"×¾", ¾"×⅞" and so on.

For the purposes of this patent the terms "fastener" and "nut" will be used interchangeably. A nut is a fastening device that is typically a square or hexagonal block, usually of metal, with a hole in the center having internal female threads that fit on the male threads of a complementary bolt, screw or stud. A bolt, screw or stud with a nut is widely used for fastening machine and structural components. An illustrative bolt includes a head, a body and threads; an illustrative hexagonal nut with female threads interfaces with the male threads of the illustrative bolt. A stud has all its length threaded with male threads and may interface with a threaded aperture of a fixture on one end and a nut on the opposite end.

In addition to the standard square and hexagonal nuts, there are many special types such as a slotted or castellated nut. In the illustrative embodiment presented herein, a hexagonal nut is used; however, it shall be appreciated by those of ordinary skill in the art that other nut geometries may be configured to interface with the nut removal tool removal described herein.

For purposes of this patent, the terms "cage" and "cartridge" will be used interchangeably. The cage "floats" or rests on an illustrative canted coiled spring which is used to engage the cage with a housing that receives a counterclockwise or clockwise force.

The canted coil spring is presented in the illustrative spring technology that allows the cage to rotate freely, while ensuring that the cage does not slide out of the housing. Alternatively, a knitted spring tube may also be used instead of the canted coil spring. The canted coil spring arid the knitted spring tube may also be referred to as a seal preload device. Other spring technologies may also be used that allow the cage (which grips the nut) and the housing (which interfaces with the cage) to rotate freely in either a counterclockwise or clockwise direction, while at the same time ensuring that the cage does not slide out of the housing.

Additionally, the illustrative embodiment presented herein includes a three-lobed cam along the interior sidewall of the housing, as described in farther detail below. The three-lobed cam is configured to interface with a cage, which interfaces with a nut. Each lobe of the illustrative three-lobed cam occupies a 120° arc and has a lobe centerline, a counterclockwise cam inner surface on one side of the lobe centerline, and a clockwise cam inner surface on the opposite side of the lobe centerline.

Generally, a counterclockwise force (to loosen the nut) is applied to the opposite enclosed channel in the housing for nut removal This counterclockwise force is transferred to fire cage when the cage interfaces with the counterclockwise cam inner surface. There may be instances when nut removal requires the application of a clockwise force (tightening the nut), and then reverting hack to the counterclockwise force.

The three-lobed cam described below is provided for illustrative purposes only. Alternatively, other lobed cam assemblies may also be used such as a two-lobed cam, a four-lobed cam, five-lobed cam, etc. The number of lobes and configuration of each lobe will depend on the particular application.

Figure 1B:
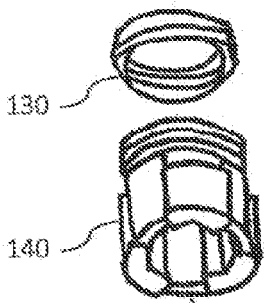
FIG. 1B shows an isometric view of the bottom portion of the illustrative flip socket nut removal tool of FIG. 1A.

Referring to FIG. 1A there is shown the top portion of an illustrative flip socket nut removal tool. In FIG. 1B there is shown an isometric view of the bottom portion of the flip socket nut removal tool of FIG. 1A. An illustrative flip socket nut removal tool 10 includes a housing 20. The housing may be composed of a material having the appropriate tool steel grade or stainless steel grade. The housing may be manufactured by machining, utilizing a mold, or other such manufacturing techniques that are specific to tool manufacturing. The housing includes a bottom surface 22 and a top surface 26. The housing 20 may interface with a rotary tool such as an impact wrench (not shown).

The top surface 26 includes an orifice defined by first interior sidewall 29 that extends to a first lip 90. The first interior sidewall 29 includes a plurality of first cam inner surfaces 30*a*, 30*b* and 30*c* along the first interior sidewall 29. The bottom surface 22 includes an orifice defined by a second inferior sidewall 170 (as shown on FIG. 3B) that extends to a second lip 179 (as shown on FIG. 3B). The second interior sidewall 170 includes a plurality of second cam inner surfaces 172*a*, 172*b* and 172*c* (as shown on FIG. 3B) along the second interior sidewall 170.

The thickness of the housing, which is measured from the interior sidewall to the exterior of the housing can be relatively thin, when compared to the thickness of typical nut removal tools. The housing thickness of the flip socket nut removal tool presented herein can be substantially thinner because the loading on the nut is spread over the cam inner surface, e.g. for 30°. In a regular nut removal tool, there is typically a substantial amount of point loading on the nut and the tool, which is more evenly spread out in the flip socket tool described herein.

Figure 7:
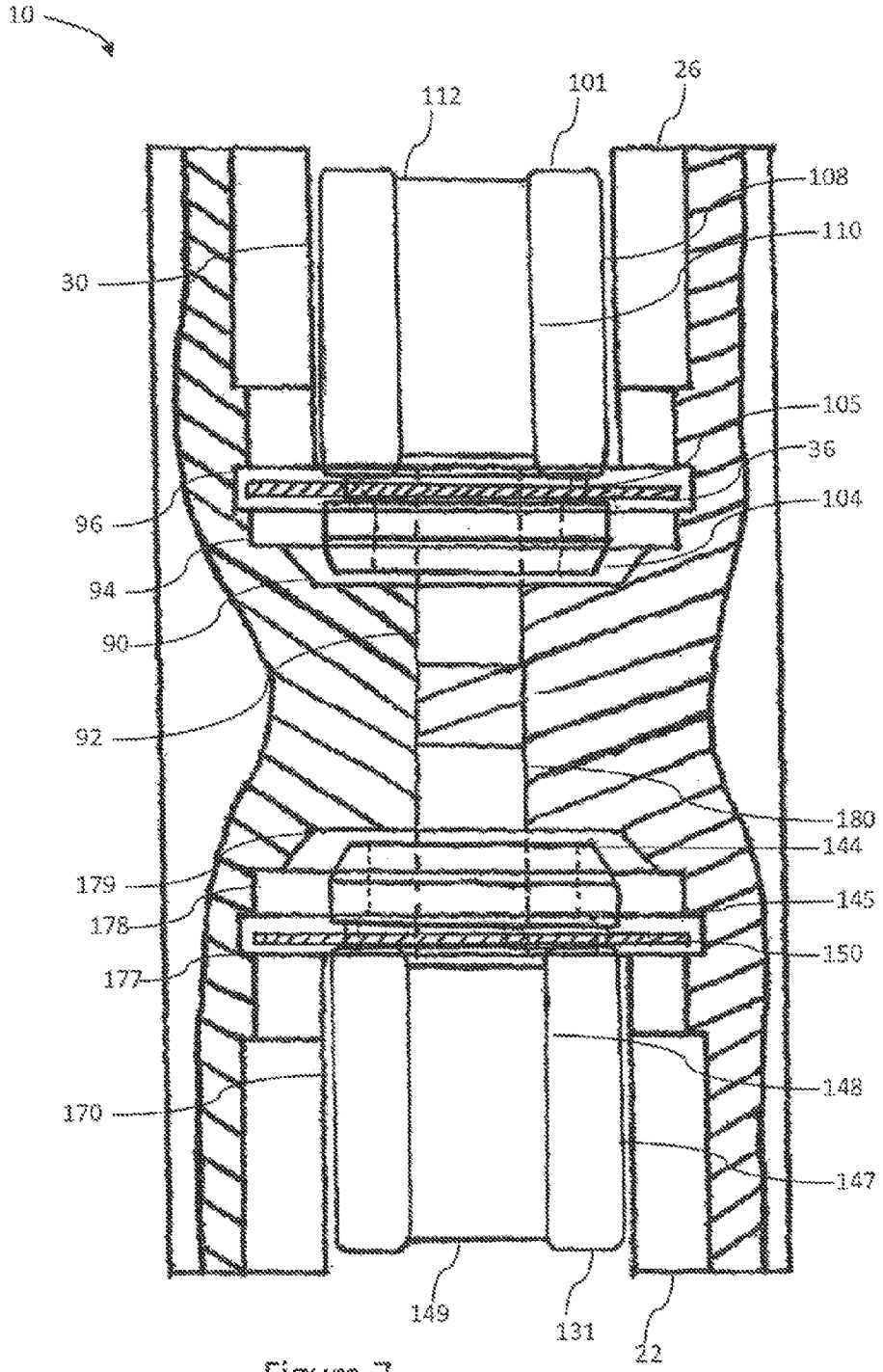
FIG. 7 shows a partial cross-sectional view of the flip socket nut removal tool with the cages and canted coil springs disposed inside the housing.

A first canted coil spring 36 rests within a groove 96 in the first interior sidewall 29 (as shown in FIG. 7). A second canted coil spring 130 rests within a second groove 177 in the second interior sidewall 170 (as shown in FIG. 7). FIG. 1B presents an exploded view of the canted coil spring 36. More generally, the canted coil spring may be referred to as a seal preload device. For example, another illustrative seal preload device is a knitted spring tube, as shown in FIG. 2D. The first canted coil spring 36 engages the first cage 40 to the housing 20, while enabling the first cage 40 to "float" on the housing. The second canted coil spring 130 engages the second cage 140 to the housing 20, while enabling the second cage 140 to "float" on the housing.

As shown in FIG. 1A, the first canted coil spring 36 and the housing 20 are configured to receive the first cage 40, and the second canted coil spring 130 and the housing 20 are configured to received the second cage 140. The housing 20 is shown in further detail in FIGS. 3A, 3B, 4 and 7 presented hereinafter. The cages 40 and 140 are described in further detail at FIGS. 5-6.

More generally, the nut removal tool 10 includes two fastening components with biasing elements that are configured to allow the cages 40 and 140 and the housing 20 to rotate freely in a counterclockwise or clockwise direction, and also enables the cages 40 and 140 to stay within the housing 20 during nut removal operations. The illustrative fastening component with the biasing element presented herein includes seal preload device such as a canted coil spring. An alternative biasing element may include a retaining ring (shown in FIG. 9) or a clip (shown in FIG. 10). Additionally, the cages 40 and 140 are interchangeable and can be substituted with other cages that have been configured to inter face with the appropriately sized nut.

Figure 2A:
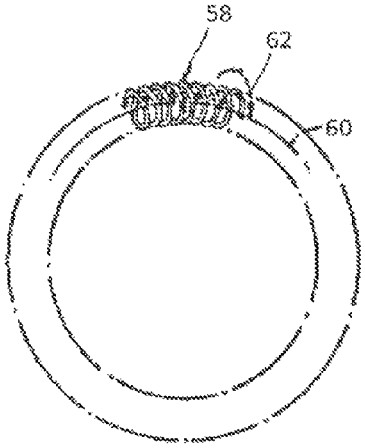
FIG. 2A shows a canted coil spring wound in a clockwise direction about the coil centerline.
Figure 2B:
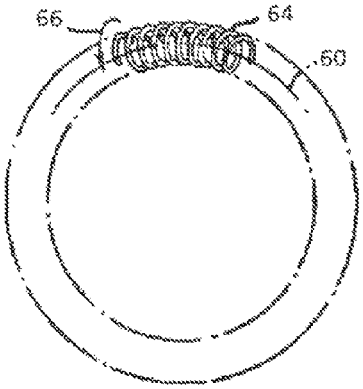
FIG. 2B shows a canted coil spring wound in a counterclockwise direction about the coil centerline.

The illustrative embodiment may include one of two types of canted coil springs, as shown in FIGS. 2A and 2B. The first type of canted coil spring 58 presented in FIG. 2A has the coils wound in a clockwise direction about the coil centerline 60 as indicated by arrow 62. The second type of canted coil spring 64 is shown in FIG. 2B and has the coils wound in a counterclockwise direction about the coil centerline 60 as indicated by arrow 66.

Figure 2C:
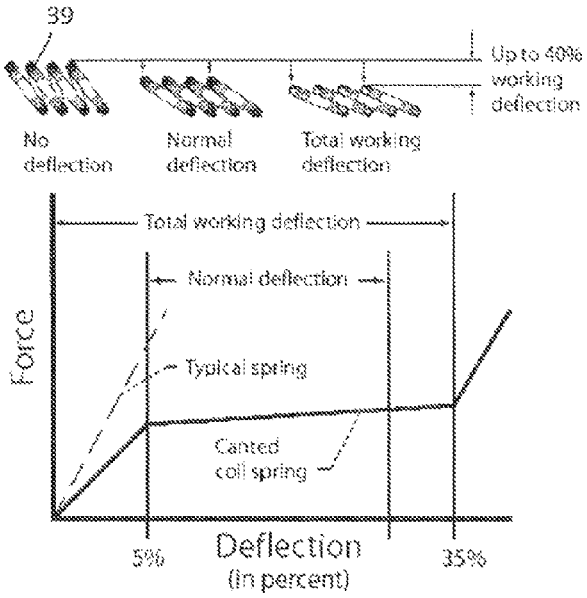
FIG. 2C shows a canted coil spring with deflection and a graph of force and deflection.
Figure 2D:
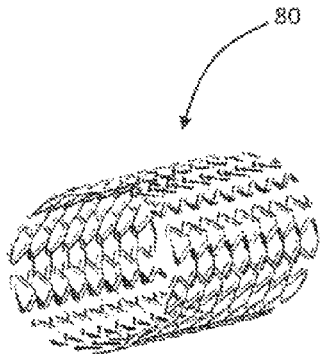
FIG. 2D shows an illustrative knitted spring tube.

Referring now to FIG. 2C, there is shown side view of a canted coil spring 36 or 130 subject to deflection from an axial load. An axial canted coil spring has its compression force 39 parallel or axial to the centerline of the arc or ring. The graph of force vs. deflection shows the canted coil spring 36 or 130 being subjected to a range of compressive (axial) forces. As more force 39 is applied to the canted coil spring 36 or 130, the angle between the coils and the vertical axis increases, in the "normal deflection" range shown in FIG. 2C, the normal deflection indicates that the force produced by a canted coil spring 36 or 130 is nearly constant over a long range of deflection, especially when compared to a typical spring. This enables the first cage 40 to "float" on the first canted coil spring 36, and the second cage 140 to float on the second canted coil spring 130.

As described in further detail below, the first canted coil spring 36 is installed within grooves in both the housing 20 and the first cage 40, and the second canted coil spring 130 is installed within grooves in both the housing 20 and the second cage 140. The canted coil spring design may be designed according to the following illustrative parameters, namely, the wire material the wire diameter, the cant amplitude, the ceils per inch, the size controlled by spring width, and eccentricity. The cant amplitude is the axial distance the top coil is shifted compared to a helical spring. The eccentricity is a parameter that indicates a circular cross section; as the eccentricity increases the spring becomes more elliptical Some manufacturers use other parameters to design a canted coil spring such as the front angle and the back angle instead of coils per inch and cant amplitude.

When a canted coil spring is deformed, the top of thee coils slide against the contact surface and the bottom coils rotate about their axis. For example, the bottom of the spring is constrained axially so the coefficient of faction is greater at the contact between the spring and the bottom surface than the spring and the top surface; this process enables the cage to "float" on the canted coil spring.

Another illustrative seal preload device is a knitted spring tube shown in FIG. 2D. The knitted spring tube 80 includes a series of needles interwoven about a base helix. The needle pattern is defined by the combination of a circular section and a linear section, in which both sections are piecewise continuous and smooth at their intersection.

Other parameters to consider for designing canted coil springs and knitted spring tubes are provided in the thesis entitled MODELING OF CANTED COIL SPRINGS AMD KNITTED SPRING TUBES AS HIGH TEMPERATURE SEAL PRELOAD DEVICES by Jay J. Oswald submitted in May 2005.

Figure 3A:
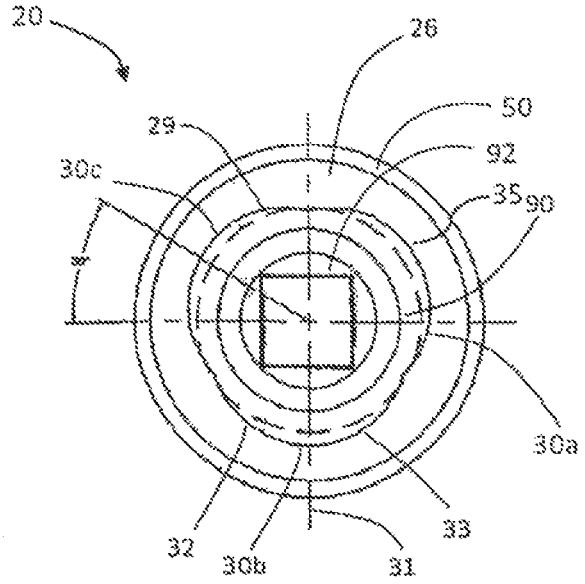
FIG. 3A shows a top view of the illustrative flip socket out removal tool.

Referring now to FIG. 3A, there is shown an illustrative a top view of the housing 20 having a three-lobed cam extending from the top surface 26. The housing includes a top surface 26, a first lip 90 and a groove (not shown) that the first canted coil spring 36 interfaces with. The first interior sidewall 29 extends item the top surface 26 to the first lip 90. The first interior sidewall 29 also includes the first three-lobed cam inner surfaces 30*a*, 30*b* and 30*c*.

By way of example and not of limitation, the housing 20 is constructed of heat treated S7 steel that measures 52-54 on the Rockwell C scale, as measured with a Hardness Tester, such as that described in U.S. Pat. No. 1,294,171, "HARDNESS TESTER," Hugh M. Rockwell, and Stanley P. Rockwell issued Feb. 11, 1919. S7 steel is a shock-resistant, air-hardening steel used for tools, and which is designed for high impact resistance at relatively high hardness in order to withstand chipping and breaking.

By way of example and not of limitation, the flip socket may also be made of heat-treated H-13, Viscount 44 steel, allowing the housing to be tough and ductile, while displaying adequate wear properties with a hardness of approximately 44 on the Rockwell C scale. The jaws of the flip socket nut removal tool may be made of the same H-13 Viscount 44 steel. Additionally, other alloys may also be used. Steels used are not plated or coated., other than surface treatment to produce a black oxide finish for corrosion resistance.

By way of example and not of limitation, the first cam inner surfaces 30*a*, 30*b* and 30*c* are equidistant from, each other so that the arcs occupied by the cams are each approximately 120°. The first three-lobed cam inner surfaces 30*a*, 30*b*, and 30*c* are configured to interface with the first cage 40, which interfaces with a first nut 115 (not shown) having a certain width. Each lobe has a lobe centerline such as lobe centerline 31. Additionally, each lobe has a first counterclockwise cam inner surface 32 on one side of the lobe centerline, and a first clockwise cam inner surface 33 on the opposite side of the lobe centerline.

The illustrative lobe centerlines are 120° apart from each other. The illustrative first counterclockwise cam inner surface 32 has a 60° arc, and the first clockwise cam inner surface 33 also has a 60° arc. The illustrative first counterclockwise cam inner surface 32 has a first clockwise cam inner surface 33*a* and 33*b* on each side. Additionally, each first clockwise cam inner surface 33 has a first counterclockwise cam inner face 32 adjacent to the first clockwise cam inner surface 33. Each lobe has a distal portion 35 along the lobe centerline that is furthest from the center of the housing.

In the embodiment presented in FIG. 3A, the distance between the distal portion of the lobe 35 and the center of the housing is greater than the semi-circular radius used to form the counterclockwise cam inner surface 32 and the clockwise cam inner surface 33. In the illustrative embodiment shown in FIG. 3A, the semi-circular radius used to form the counterclockwise cam inner surface 32 and the clockwise cam inner surface 33 share the same center radius. Alternatively, the semi-circular radius used to form the counterclockwise cam inner surface 32 and the clockwise cam inner surface 33 may each have different center radii.

Figure 3B:
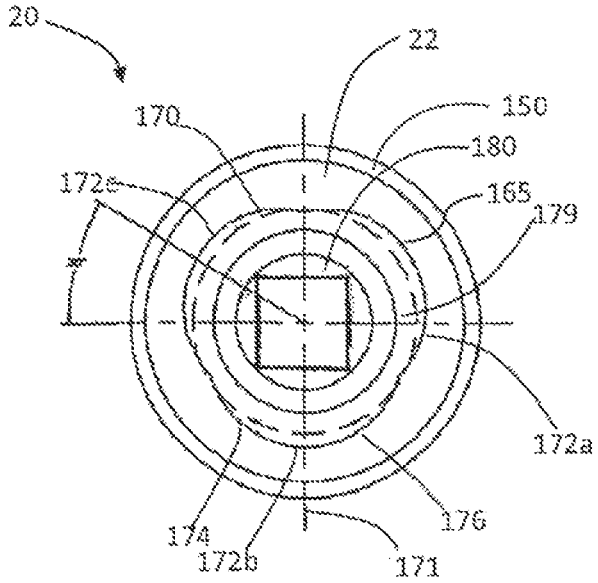
FIG. 3B shows a bottom view of the illustrative flip socket nut removal tool.

Referring now to FIG. 3B, there is shown an illustrative bottom view of the housing 20 having a three-lobed cam extending from the bottom surface 22. The housing includes a bottom surface 22, a second lip 179 and a groove (not shown) that the second canted coil spring 130 interfaces with. The second interior sidewall 170 extends from bottom surface 22 to the second lip 179. The second Interior sidewall 170 also includes the second three-lobed cam inner surfaces 172*a,* 172*b* and 172*c*.

The thickness of the material comprising the housing in the illustrative embodiment may be 30/1000 thick. The reason the housing material can be as thin as 30/1000, in comparison to the prior art which uses much thicker housing material, is because loading of force from the impact tool is spaced over 30 degrees, reducing point loading on the housing, so that the nut is released from the fixture before the flip socket yields.

The second cam inner surfaces 172*a,* 172*b* and 172*c* are equidistant horn each other so that the arcs occupied by the cams are each approximately 120°. The second three-lobed cam inner surfaces 172*a,* 172*b* and 172*c* are configured to interface with, the second cage 140, which interfaces with a second out 125 (not shown) having a width which is different from the first nut 115. Each lobe has a lobe centerline such as lobe centerline 171. Additionally, each lobe has a second counterclockwise cam inner surface 174 on one side of the lobe centerline, and a second clockwise cam inner surface 176 on the opposite side of the lobe centerline.

The illustrative second, counterclockwise cam inner surface 174 has a 60° arc, and the second clockwise cam inner surface 176 also has a 60° arc. The illustrative second counterclockwise cam inner surface 174 has a second clockwise cam Inner surface 176*a* and 176*b* on each side. Additionally, each second clockwise cam inner surface 176 has a second counterclockwise cam inner surface 174*a* and 174*b* adjacent to the second clockwise cam inner surface 176. Each lobe has a distal portion 165 along the lobe centerline that is furthest from the center of the housing.

In the embodiment presented in FIG. 3B, the distance between the distal portion of the lobe 165 and the center of the housing is greater than the semi-circular radius used to form the counterclockwise cam timer surface 174 and the clockwise cam inner surface 176. In the illustrative embodiment shown in FIG. 3B, the semi-circular radios used to form the counterclockwise cam inner surface 174 and the clockwise cam loner surface 176 share the same center radius. Alternatively, the semi-circular radius used to form the counterclockwise cam inner surface 174 and the clockwise cam inner surface 176 may each have different center radii.

In the illustrative embodiments of FIGS. 3A and 3B, the illustrative three-lobed cam inner surfaces include six different cam inner surfaces, in which three cam inner surfaces are clockwise can surfaces and three cam inner surfaces are counterclockwise cam surfaces.

Generally, a counterclockwise force (to loosen the first nut) is applied to the top surface 26 of the housing 20 for nut removal using the first cage 40. This counterclockwise force is transferred to the first cage 40 when the cage interfaces with the counterclockwise cam inner surface 32. There may be instances when nut removal requires the application of a clockwise force (tightening the nut) so the housing 20 is turned in a clockwise direction and this force is then transferred to the first cage 40 with the clockwise cam inner surface 33.

Likewise, a counterclockwise force (to loosen the second nut) is applied to the bottom surface 22 of the housing 20 for nut removal using the second cage 140. This counterclockwise force is transferred to the second cage 140 when the second cage interfaces with the second counterclockwise cam inner surface 174. There may be instances when nut removal requires the application of a clockwise force (tightening the nut) so the housing 20 is turned in a clockwise direction and this force is then transferred to the second cage 140 with the second clockwise cam inner surface 176.

An illustrative impact wrench may be employed that has an operator controlled switch that can switch the direction of the force applied to the nut removal tool from counterclockwise, to clockwise, and back to counterclockwise. By performing this operation of oscillating between the counterclockwise and clockwise directions, additional torque may be transferred to the not to more effectively remove the nut.

The illustrative three-lobed cam inner surfaces 30 or 172 are symmetrical and presented far illustrative purposes only. Alternatively, other symmetrical lobed cam assemblies may also be used such as a two-lobed cam, a four-lobed cam, five-lobed cam, etc. The number of lobes and configuration of each lobe will depend on the particular application.

Additionally, each lobe may have more than just two symmetrical cam surfaces (i.e. clockwise inner cam surface and counterclockwise inner cam surface). For example, each lobe may have three, four, five or six different cam inner surfaces that can interface with different cages or cartridges.

Furthermore, asymmetrical cam inner surfaces may also be employed. Thus, the lobed cam inner surface may have additional surfaces beyond just the symmetrical three-lobed cam surface presented herein. The inner cam surface may be asymmetrical and include a plurality of surfaces that can interface with a plurality of different cages.

Referring back to FIG. 3A, the rotary power tool is configured to slidably couple with the second polygon shaped enclosed channel 92 when the first cage 40 engages with the first nut 115 (not shown). In FIG. 3B, the rotary power tool is configured to slidably couple with the first polygon shaped enclosed channel 180 when the second cage 140 engages with the second nut 125.

The illustrative rotary tool may be an impact wrench (not shown) having an anvil (not shown) configured to be received by at least one of the polygon shaped enclosed channels 92 and 180. Although the enclosed channels are shown as being square shaped, a circular or elliptical shaped opening may also be configured to match the shape of the rotary power tool.

By way of example and not of limitation, the illustrative impact wrench is a 0.5 inch impact wrench that has a square anvil. The flip socket nut tool described herein will also likely operate in conjunction with an anvil extension (not shown) that is received by the illustrative 0.5 inch impact wrench. As is well known in the art, the anvil extension includes at ball at the end of the anvil that is configured to interlace with the enclosed channel that includes a depression (not shown) that receives the ball near the tip of the anvil extension. The torque from the impact wrench is then transferred to the housing via the sidewalls of the square shaped enclosed channel.

An impact wrench is a power tool, that delivers a high torque output by storing energy in a rotating mass and then delivering the energy to the output shaft. The power source for an impact wrench is generally compressed air. When a hammer, i.e. rotating mass, is accelerated by the power source and then connected to an anvil, i.e. output shaft, this creates the high-torque impact. When the hammer spins, the hammer's momentum is used to store kinetic energy that is then delivered to the anvil in a theoretically elastic collision having a very short impact force.

With an impact wrench, the only reaction force applied to the body of the tool is the motor accelerating the hammer, and thus the operator feels very little torque, even though a very high peak torque is delivered to the anvil. The impact wrench delivers rotational forces that can be switched between counterclockwise rotation and clockwise rotation. Additionally, the impact wrench delivers oscillating compressive forces along the axis of the anvil and of the impact wrench. Thus, when removing a nut, the anvil of the impact wrench is typically along a vertical axis and the impact wrench delivers oscillating compressive forces along the axis of the anvil, i.e. axial load, and rotational forces.

For the embodiments described herein, relatively small impact wrenches are used. These small impact wrenches generally deliver less than 2,000 foot-pounds of torque and have a 1-inch anvil. Impact wrenches with an anvil that 1-inch or smaller can be used for common applications such as in automotive manufacturing, automotive repair, and for removing and installing wheels when changing tires. Alternatively, other rotary power tools may also be used instead of the impact wrenches described herein. For example, a standard or "regular" drill may also be used as a rotary tool.

In the illustrative embodiment an extended anvil is attached to the impact wrench. A typical anvil for an impact wrench cannot teach through the first cage 40 to engage the first channel 92. Also, a typical anvil for an impact wrench cannot reach through the second cage 140 to interface with second channel 180. An extended anvil therefore is used to reach into spaces that a typical anvil cannot reach into.

Figure 4:
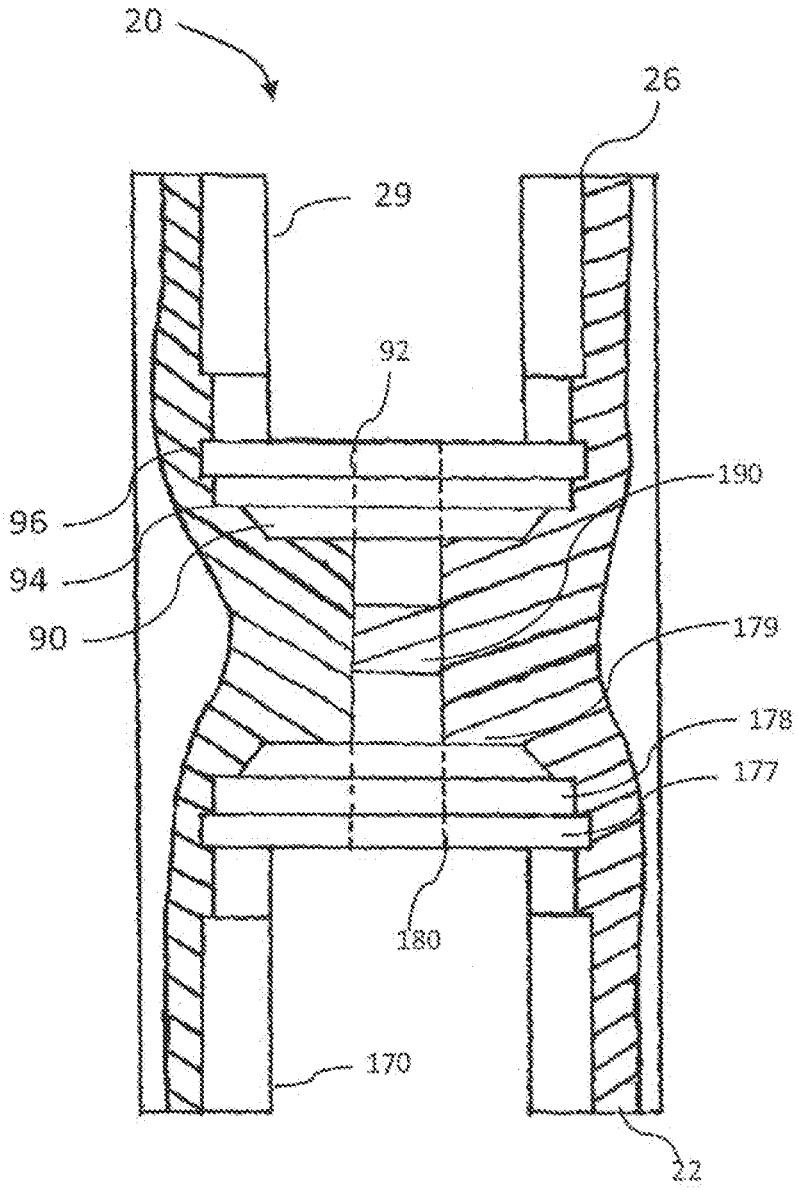
FIG. 4 shows a partial cross-sectional view of the flip socket nut removal tool without the cage or canted coil spring.

Referring to FIG. 4 there is shown a cross-sectional view of the housing 20. The first housing groove 96 of the first interior sidewall 29 that extends horn the top surface 26 to the first lip 90 is configured to receive the first canted coil spring 36 (not shown). The first housing groove 96 extends around the inner perimeter of the first interior sidewall 29 of the housing 20, The first groove 96 may include a shoulder 94 disposed below the first interior sidewall 29 and above the first lip 90. A first channel 92 extends from the first lip 90 to the top of a partition 190.

The second housing groove 177 of the second interior sidewall 170 that extends from the bottom surface 22 to the second lip 179. The second housing groove 177 extends around the inner perimeter of the second interior sidewall 170 of the housing 20. The second housing groove 171 may include a shoulder 178 disposed below the second interior sidewall 170 and above the second lip 179. A second channel 180 extends from the second lip 179 to the bottom of the partition 190.

In an alternative embodiment, the housing 20 has a top surface 26 having a certain width, and a bottom surface 22 with a width different from the top surface.

Additionally, the illustrative canted coil spring 36 or 130 may have the coils canted in either a clockwise or counterclockwise direction depending on the particular application and design constraints.

Figure 5A:
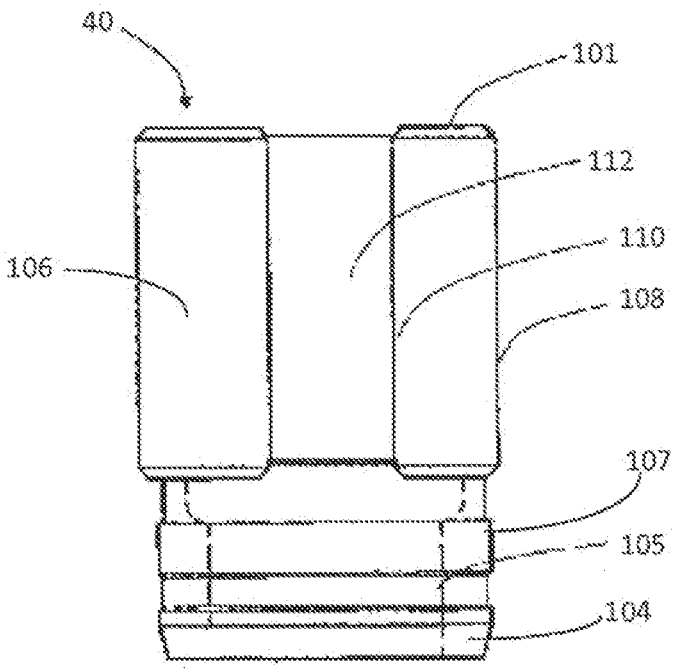
FIG. 5A shows a side view of an illustrative first cage.

Referring to FIG. 5A, there is shown a side view of the illustrative first cage 40. The first cage 40 is configured to interface with the first interior sidewall 29 and with the first canted coil spring 36. The first cage 40 has a first cage top surface 101 and a first bottom portion 107 ending in a first tapered terminus 104 configured to interface with the first lip 90 (not shown) of the housing 20. By way of example and not of limitation, the first bottom portion 107 is a steel ring. Additionally, the first cage 40 has a first cage groove 105 disposed on the first bottom portion 107, the first cage groove 105 configured to interface with the first canted coil spring 36 (not shown). The first cage also includes a plurality of jaws 106 which have a first cage cam outer surface 108 and a first cage cant inner surface 110. A first elastic webbing 112 joins the plurality of jaws.

Figure 5B:
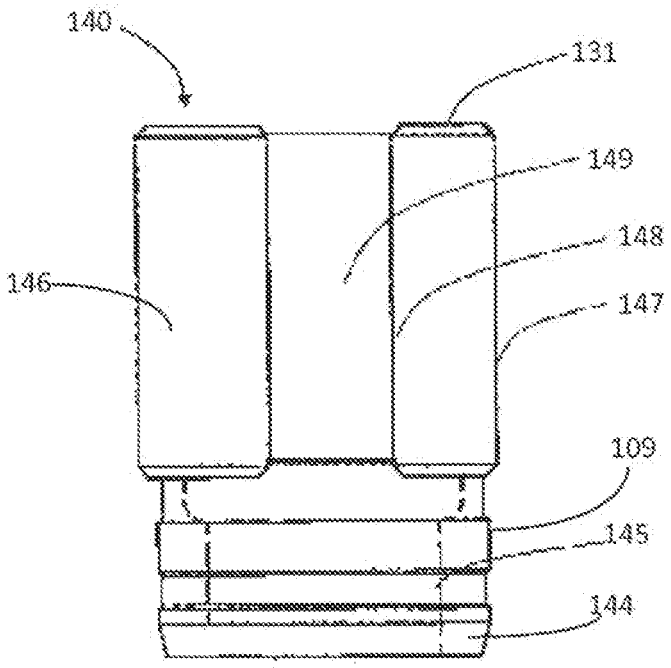
FIG. 5B shows a side view of an illustrative second cage.

Referring now to FIG. 5B, the second cage 140 is configured to interface with the second interior sidewall 170 and with the second canted coil spring 130. The second cage 140 has a second cage top surface 131 and a second bottom portion 109 ending in a second tapered terminus 144 configured to interface with the second lip 180 (not shown) of the housing 20. By way of example and not of limitation, the second bottom portion 109 is a steel ring. Additionally, the second cage 140 has a second cage groove 145 disposed on the second bottom portion 109, the second cage groove 145 configured to interface with the second canted coil spring 130 (not shown). The second cage also includes a plurality of jaws 146 which have a second cage cam outer surface 147 and a second cage cam inner surface 148. A second elastic webbing 149 joins the plurality of jaws.

Figure 6A:
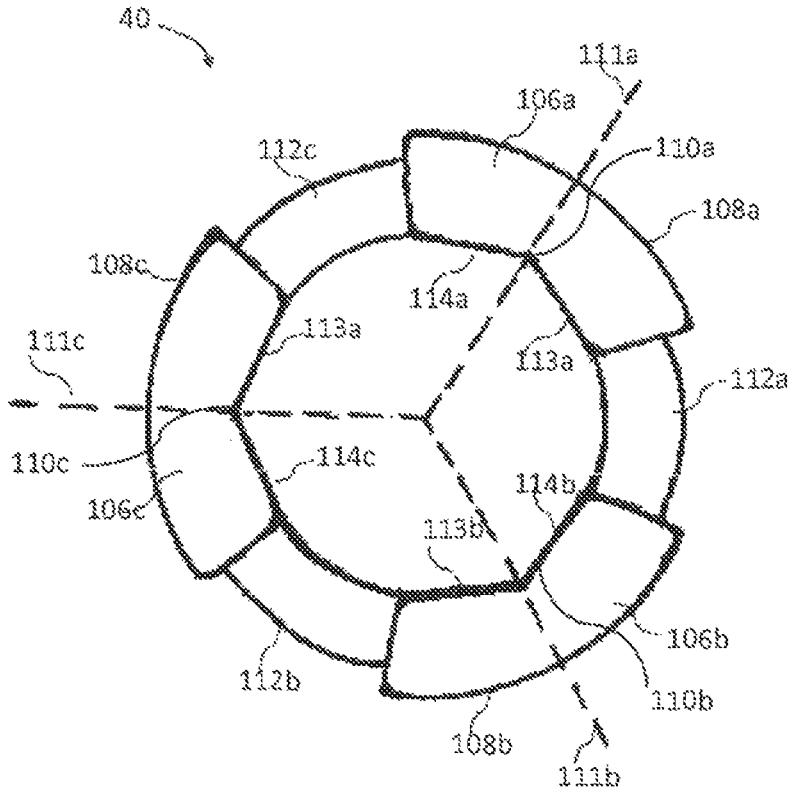
FIG. 6A shows a top view of the illustrative first cage.

Referring now to FIG. 6A, the first cage includes a plurality Of first cage jaws 106*a*, 106*b* and 106*c*. Each of the first cage jaws 106*a*, 106*b* and 106*c* includes a first cage jaw outer cam surface 108*a*, 108*b*, and 108*c* and a first cage jaw inner cam surface 110*a*, 110*b*, and 110*c*, respectively. Each first cage jaw inner cam surface 110 has a first cage jaw centerline 111*a*, 111*b* and 111*c*, a first cage counterclockwise cam inner surface 113*a*, 113*b* and 113*c* on one side of the first cage jaw centerline, and a first cage clockwise cam inner surface 114*a*, 114*b* and 114*c* on the opposite side of the first cage jaw centerline. The first cage jaw centerlines are 120° apart from each other. Thus, the illustrative three first cage jaw cam inner surfaces include six different cam inner surfaces, in which three first cage cam inner surfaces are clockwise cam surfaces and three first cage cam Inner surfaces are counterclockwise cam surfaces.

Figure 8A:
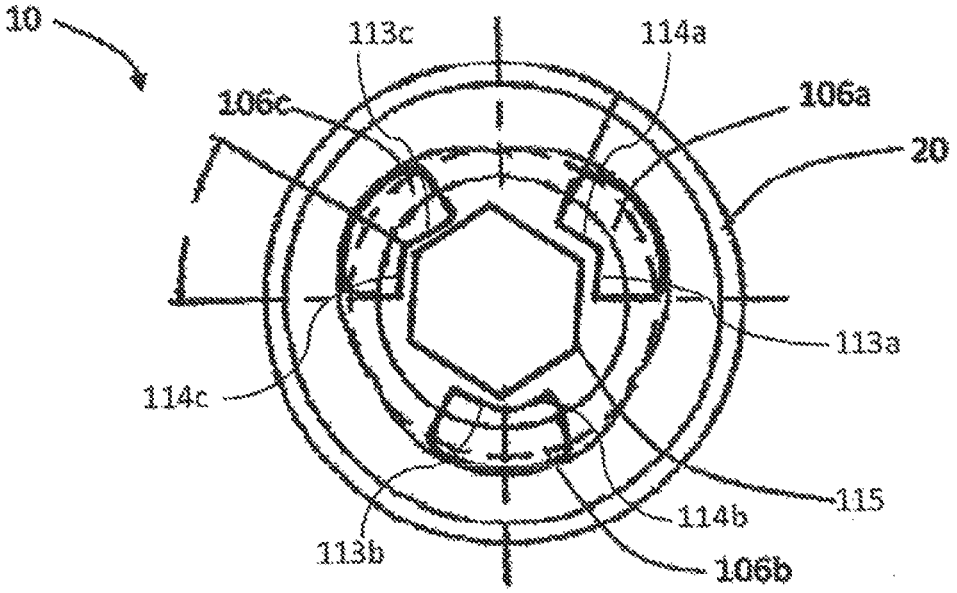
FIG. 8A shows a top view of the housing with the illustrative first cage positioned within the housing. The jaws of the first cage are shown its a first position with the jaws not contacting the first nut.

In the illustrative embodiment, the first cage counterclockwise cam inner surface 113*a*, 113*b* and 113*c* on one side of the first cage jaw centerline, and a first cage clockwise cam inner surface 114*a*, 114*b* and 114*c* on the opposite side of the first cage jaw centerline grip three corners of the illustrative hexagonal nut as shown in FIG. 8A. Each first cage jaw outer cam surface 108 occupies a 60° arc. The first cage jaw outer cam surface 108 is configured to interface with the first cam inner surface 30 corresponding to the interior sidewall 29.

The illustrative first cage 40 also includes an illustrative first elastic webbing 112. The elastic webbing 112 maintains symmetry between the jaws 106, keeping the cam surfaces 113 and 114 pressed firmly against the first housing cam inner surface 30. The illustrative first cage elastic webbing 112*a* joins jaws 106*a* and 106*b*. Also, first elastic webbing 112*b* joins jaws 106*b* and 106*c*. Additionally, first elastic webbing 112*c* joins jaws 106*a* and 106*c*.

Figure 6B:
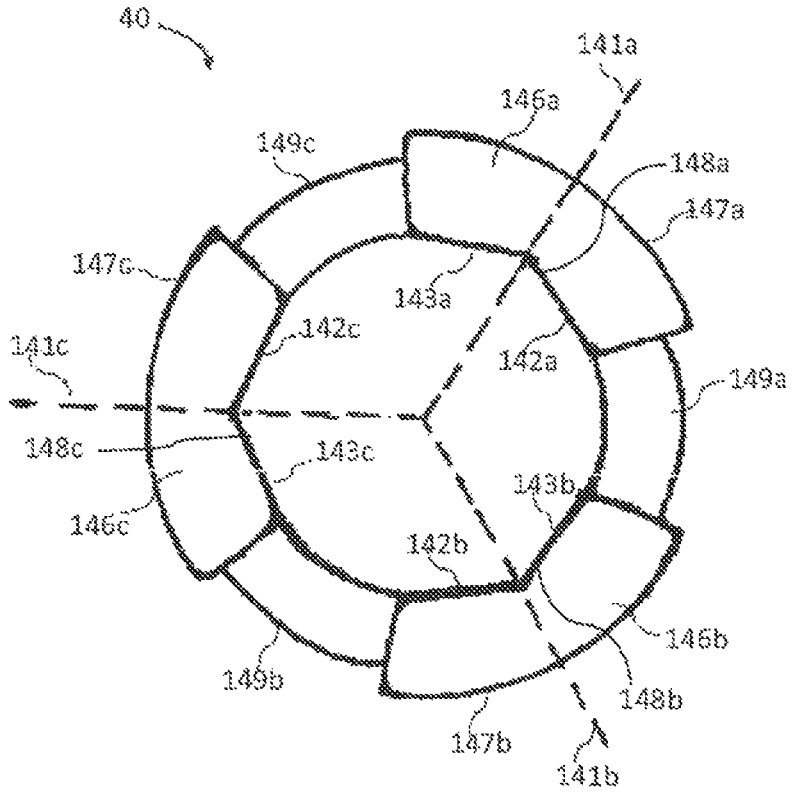
FIG. 6B shows a top view of the illustrative second cage.

Referring now to FIG. 6B, the second cage includes a plurality of second cage jaws 146*a*, 146*b*, and 146*c*. Each of the second cage jaws 146*a*, 146*b* and 146*c* includes a second cage jaw outer cam surface 147*a*, 147*b*, and 147*c* and a second cage jaw inner cam surface 148*a*, 148*b*, and 148*c*, respectively. Each second, cage jaw inner cam surface has a second cage jaw centerline 141*a*, 141*b* and 141*c*, a second cage counterclockwise cam inner surface 142*a*, 142*b* and 142*c* on one side of the second cage jaw centerline, and a second cage clockwise cam inner surface 143*a*, 143*b* and 143*c* on the opposite side of the second, cage jaw centerline. The second cage jaw centerlines are 120° apart from each other. Thus, the illustrative three second cage jaw cam inner surfaces include six different cam inner surfaces, in which, three second cage cam inner surfaces are clockwise cam surfaces and three second cage cam inner surfaces are counterclockwise cam surfaces.

In the illustrative embodiment, the second cage counterclockwise cam inner surface 142*a*, 142*b* and 142*c* on one side of the second cage jaw centerline, and a second cage clockwise cam inner surface 143*a*, 143*b* and 143*c* on the opposite side of the second cage jaw centerline grip three corners of the illustrative hexagonal nut, as shown in FIG. 5B. Each second cage jaw outer cam surface 147 occupies a 60° arc. The second cage jaw outer cam surface 147 is configured to interface with the second cam inner surface 172 corresponding to the interior sidewall 170.

The illustrative second cage 140 also includes a second elastic webbing 149. The second elastic webbing 149 maintains symmetry between the jaws 146, keeping the second cage jaw outer cam surfaces 148 pressed firmly against the second housing cam inner surface 172. The illustrative second elastic webbing 149*a* joins jaws 146*a* and 146*b*. Also, second elastic webbing 149*b* joins jaws 146*b* and 146*c*. Additionally, second elastic webbing 149*c* joins jaws 146*a* and 146*c*.

The webbing may also be embodied as an injection molded elastomeric cartridge or cage. By way of example and not of limitation the elastomeric component configured to join the jaws has a durometer ranging from 20-40. In a narrower embodiment, the elastomeric material has a durometer of 30. Generally, the webbing material is composed of an elastic material that can withstand operating conditions for nut removal. For example, the webbing matter may be composed of an elastic thermoplastic resin that is resistant to petroleum products. Also, other elastic or elastomeric materials such as rubber or neoprene may also be used.

By way of illustration and not limitation, nuts used in attaching tires to axles for automobiles are typically of several sizes. In the illustrative embodiment, the flip socket nut removal tool has a 13/16" socket on one end, and a ¾ socket on the other end. In a further illustrative embodiment, the flip socket nut removal tool has a 19 mm socket on one end and a 17 mm socket on the other end.

Referring now to FIG. 7, when inserted into the housing 20, the first cage 40 slidably engages with the first cam inner surfaces 30*a*, 30*b* and 30*c* (not shown) on the first interior sidewall 29 of the housing 20. The first tapered terminus 104 slides past the first canted coil spring 36 fitted within the first housing groove 96, and the first canted coil spring 36 is received by a first cage groove 105. When the first canted coil spring 36 is secured within both the first housing groove 96 and the first cage groove 105, the first tapered terminus 104 latches raider the first canted coil spring 36, holding the first cage 40 in place within the housing 20.

When the second cage 140 is inserted into the orifice in the bottom surface 22 of the housing 20, the second cage 140 slidably engages with the second cam inner surfaces 172*a*, 172*b* and 172*c* (not shown) on the second interior sidewall 170 of the housing 20. The second tapered terminus 144 slides past the second canted coil spring 130 fitted within the second housing groove 177, and the second canted coil spring 130 is received by a second cage groove 145. When the second canted coil spring 130 is secured within both the second housing groove 177 and the second cage groove 145, the second tapered, terminus 144 latches under the second canted coil spring 130, holding the second cage 140 in place within the housing 20.

Referring now to FIG. 8A there is shown a sectional top view of the nut removal tool 10 with the first cartridge 40 inside of the housing 20, and the first jaws 106*a*, 106*b* and 106*c* interfacing with an illustrative first hexagonal nut 115, which is placed with the housing 20. The first jaws 106*a*, 106*b* and 106*c* are shown in a resting position, in which no force is applied to the housing 20. In this resting position, the first jaws 106 are not engaging the run and the elastic webbing used to join the jaws causes the earns to return to the resting position, in which the jaw outer cam surface is configured to interface with the cam inner surface that is furthest from the illustrative hexagonal nut 115. Thus, in this resting position the nut removal tool is capable of accepting the nut before a rotational force is applied to the nut.

Figure 8B:
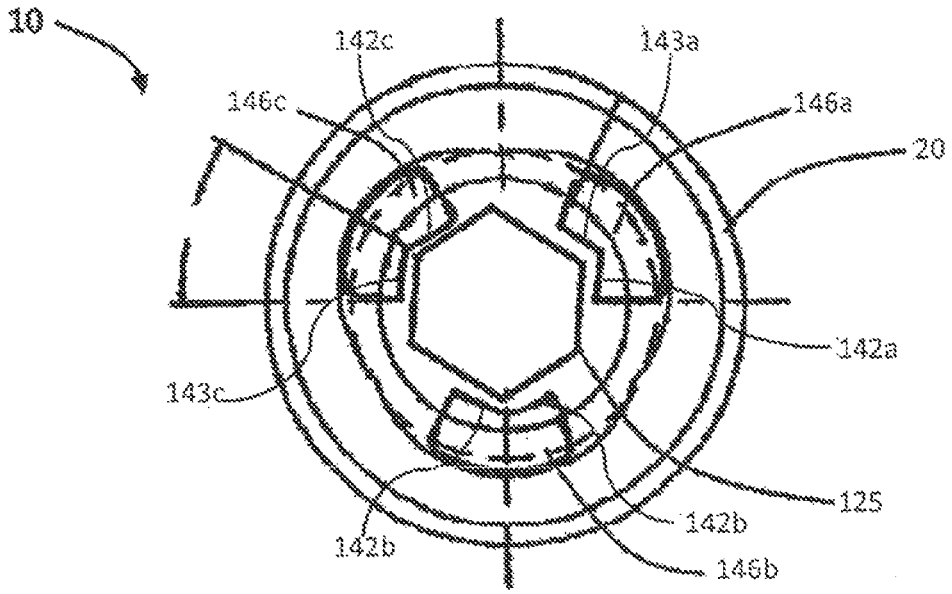
FIG. 8B shows a bottom view of the housing with the illustrative second cage positioned within the housing. The jaws of the second cage are shown in a first position with the jaws not contacting the first nut.

Referring now to FIG. 8B there is shown a sectional top view of the ant removal 10 with the second cartridge 140 inside of the housing 20, and the second jaws 146*a*, 146*b* and 146*c* interfacing with an illustrative second hexagonal nut 125. In FIG. 8B, the second hexagonal nut 125 has a width that is greater than the first nut 115 shown in FIG. 8A. In FIG. 8B, the second hexagonal nut 123 is placed within the housing 20. The second jaws 146*a*, 146*b* and 146*c* are shown in a resting position, in which no force is applied to the housing 20. In this resting position, the second jaws 146 are not engaging the nut and the elastic webbing used to join the jaws causes the cams to return to the resting position, in which the jaw outer cam surface is configured to interface with the cam inner surface that is furthest from the illustrative hexagonal nut 125. Thus, in this resting position the nut removal tool is capable of accepting the nut before a rotational force is applied to the nut.

When a counterclockwise force is applied to the second channel 180 in the housing 20, and the first hexagonal nut 115 is within the first cage 40, this causes the housing 20 to shift approximately 30° to the left and the first jaws 106 are biased radially inwards by the first inner housing cam 30. The housing 20 is rotated by a rotary power source, such as the air impact wrench described above, and the first jaw outer cam surfaces 108*a*, 108*b* and 108*c* are configured to engage with the first counterclockwise cam interface 113*a*, 113*b* and 113*c* when a counterclockwise force is applied to the second channel 180 of the housing 20. When the first jaws 106 are biased radially inwards by the first counterclockwise cam interlace 113 and the effective circumference of the first cartridge 40 is reduced, this causes the first elastic webbing 112 to flex (not shown). When the first jaws 106 are biased radially inwards, the first jaw inner cam counterclockwise surface 113 engages the nut.

When the housing 20 is rotated counterclockwise relative to the first cage and the first hexagonal nut 115 is within the first cage 40, the first jaw inner counterclockwise cam surfaces 113*a*, 113*b* and 113*c* engage three of the surfaces of the head of the first hexagonal nut 115, rotating the first hexagonal nut counterclockwise for nut removal. When the housing 20 is rotated clockwise relative to the first cage and the first hexagonal nut 115 is within the first cage 40, the first jaw inner clockwise cam surfaces 114*a*, 114*b* and 114*c* engage the other three surfaces of the head of the first hexagonal nut 115, rotating the first nut clockwise for tightening the nut.

When a counterclockwise force is applied to the first channel 92 in the housing 20, and the second hexagonal nut 125 is within the second cage 140, this causes the housing 20 to shift approximately 30° to the left and the second jaws 146 are biased radially inwards by the second inner housing cam 172. The housing 20 is rotated by a rotary power source, such as the air impact wrench described above and the second jaw outer cam surfaces 147*a,* 147*b* and 147*c* are configured to engage with the second counterclockwise cam interface 142*a,* 142*b* and 142*c* when a counterclockwise force is applied to the first channel 92 of the housing 20. When the second jaws 146 are biased radially inwards by the second counterclockwise cam interface 142 and the effective circumference of the second cartridge 140 is reduced, this causes the second elastic webbing 149 to flex (not shown). When the second jaws 146 are biased radially inwards, the second jaw inner cam counterclockwise surface 142 engages the nut.

When the housing 20 is rotated counterclockwise relative to the second cage and the second hexagonal nut 125 is within the second cage 140, the second Jaw inner counterclockwise cam surfaces 142*a,* 142*b* and 142*c* engage three of the surfaces of the head of the second hexagonal nut 125, rotating the second hexagonal nut counterclockwise for nut removal. When the housing 20 is rotated clockwise relative to the second cage and the second hexagonal not 125 is within the second cage 140, the second jaw inner clockwise cam surfaces 143*a*, 143*b* and 143*c* engage the other three surfaces of the head of the second hexagonal nut 125, rotating the second nut clockwise for tightening the not.

The illustrative jaws or 146 having three jaws are symmetrical and are presented for illustrative purposes only. Alternatively, other symmetrical jaw inner cam assemblies may also be used such as an assembly having two jaws, four jaws, five jaws, etc. The number of jaws and configuration of each jaw will depend on the particular application.

Additionally, each jaw may have more than just two symmetrical cam surfaces (i.e. clockwise inner cam surface and counterclockwise inner cam surface). For example, each jaw may have three, four, five or six different cam inner surfaces that can interface with different shaped nut heads.

Furthermore, asymmetrical jaw cam inner surfaces may also be employed. Thus, the jaw cam inner surface may have additional surfaces beyond just the symmetrical three-jaw cam surface presented herein. The jaw inner cam surface may be asymmetrical and include a plurality of surfaces that can interface with a plurality of different nut head shapes.

More specifically, the nut removal tool is configured to turn in a counterclockwise manner relative to the first cage 40. This rotation causes the first cam inner surfaces 30*a,* 30*b* and 30*c* of the housing 20 to apply force to the first cam outer surfaces 108 of the first cartridge 40 containing the first jaws 106*a,* 106*b* and 106*c*. In operation, the deformation of the elastomer upon the application of torque allows for the first jaw counterclockwise cam inner surface 113 and the first jaw clockwise cam inner surface 114 to contact the first nut 115 at multiple contact points.

The nut removal tool is further configured to turn in a counterclockwise manner relative to the second cage 140. This rotation causes the second cam inner surfaces 172*a,* 172*b* and 172*c* of the housing 20 to apply force to the second cam outer surfaces 147 of the second cartridge 140 containing the second jaws 146*a*, 146*b* and 146*c*. In operation, the deformation of the elastomer upon the application of torque allows for the second jaw -counterclockwise cam inner surface 142 and the second jaw clockwise cam inner surface-143 to contact the second nut 125 at multiple contact points.

Additionally, the first jaw outer cam surface 108 is configured to engage with the housing first clockwise cam interface 33 when a clockwise force is applied to the second channel 180 of the housing 20. Further, the second jaw outer cam surface 147 is configured to engage with the housing first clockwise cam interface 176 when a clockwise force is applied to the first channel 92 of the housing 20. During nut removal, the operator may increase the amount torque applied to the nut by toggling between, applying a counterclockwise force and a clockwise force using the nut removal assembly described herein.

Generally, the flip socket nut removal tool described herein removes relatively small nuts, e.g. lug nuts, when compared to the co-pending nut removal tool. An alternative to the canted coil springs includes retaining rings (not shown) or other fastening means such as a clip (not shown).

Other fastening means may readily suggest themselves to those of ordinary skill in the art. Generally, these fastening means may also be used that allow the cage 40 or 140 and the housing 20 to rotate freely in a counterclockwise or clockwise direction, while at the same time ensuring that the cage 40 or 140 does not slide out of the housing.

It is to be understood that the detailed description of illustrative embodiments provided for illustrative purposes. The scope of the claims is not limited to these specific embodiments or examples. Various structural limitations, elements, details, and uses can different from those just described, or be expanded on or implemented using technologies not yet commercially viable, and yet still be within the inventive concepts of the present disclosure. The scope of the invention is determined by the following claims and their legal equivalents.

What is claimed is:

1. An apparatus for removing a first nut and a second nut, wherein the size of the first nut is different than the size of the second nut, the apparatus comprising:

a housing that includes, a housing top surface having a first orifice that extends to a first lip;

a first interior sidewall that extends from the housing top surface to the first lip, wherein the first interior sidewall includes a first lobed cam disposed along the first interior sidewall;

a housing bottom surface with a second orifice extending to a second lip;

a second interior sidewall that extends from the housing bottom surface to the second lip wherein the second interior sidewall includes a second lobed cam disposed along the second interior sidewall;

an enclosed channel between the first lip and the second first lip configured to interface with a rotary tool inserted from either the housing top surface or the housing bottom surface;

a first cage having a first cage terminus and a first cage groove disposed between a first cage top surface and fire first cage terminus, the first cage includes a plurality of jaws configured to interface with the first nut;

a second cage having a second cage terminus and a second cage groove disposed between a second cage top surface and the second cage terminus, the second cage includes a plurality of jaws configured to interface with the second nut; and each jaw includes, a jaw outer cam surface that is configured to interface with a cam inner surface corresponding to the interior sidewall, a jaw inner cam surface configured to interface with one of the first nut and second nut.

2. The apparatus of claim 1 wherein each lobe is substantially semi-circular.

3. The apparatus of claim 2 further comprising an elastic component configured to join the plurality of jaws.

4. The apparatus of claim 3 wherein each lobed cam includes a plurality of lobes, in which each lobe has a lobe center line and a first counterclockwise cam inner surface on one side of the lobe center line and a first clockwise cam inner surface on the opposite side of the lobe center line.

5. The apparatus of claim 4 wherein the enclosed channel is configured to interface with a rotary tool that can oscillate between applying a counterclockwise force and a clockwise force.

6. The apparatus of claim 1 wherein the enclosed channel in the housing is configured to interface with an anvil of a rotary tool.

7. The apparatus of claim 1 wherein the first cage terminus and the second cage terminus each are tapered.

8. An apparatus for removing a first nut and a second nut wherein the size of the first nut is different than the size of the second nut, the apparatus comprising:

a housing, the housing includes, a housing top surface having a first orifice that extends to a first lip;

a first interior sidewall that extends from the housing top surface to the first lip, wherein the first interior sidewall includes, a first lobed cam disposed along the first interior sidewall, a first groove between the top surface and the first lip;

a bottom surface having a second orifice that extends to a second lip;

a second interior sidewall that extends from the housing bottom, surface to the second lip wherein the second interior sidewall includes, a second lobed cam disposed along the second interior sidewall, a second groove disposed between the bottom surface and the second lip;

an enclosed channel between the first lip and the second lip configured to interface with a rotary tool inserted from alternately the housing top surface and the housing bottom surface;

a first cage having a first cage top surface and a first cage bottom portion, the first cage bottom portion includes a first cage groove and a first cage terminus, the first cage groove disposed between the first cage top surface and the first cage terminus, the first cage includes a plurality of jaws configured to interface with the first nut;

a first canted coil spring configured to be received by the groove of the first interior sidewall and the groove of the first cage;

a second cage having a second cage top surface and a second cage bottom portion, the second cage bottom portion includes a second cage groove and a second cage terminus, the second cage includes a plurality of jaws configured to interface with the second nut;

a second canted coil spring configured to be received by the groove of the second interior sidewall and the groove of the second cage;

the housing configured to rotate counterclockwise relative to the first cage; and the housing configured to rotate counterclockwise relative to the second cage.

9. The apparatus of claim 8 wherein the first cage is configured to rotate counterclockwise and engage the first nut, the first cage configured to interface with the first interior sidewall, and the second cage is configured to rotate counterclockwise and engage the second nut, the second cage configured to interface with the second interior sidewall.

10. The apparatus of claim 8 wherein the first canted coil spring has the coils canted in a clockwise direction.

11. The apparatus of claim 8 wherein the first canted coil spring has the coils canted in a counterclockwise direction.

12. The apparatus of claim 8 wherein each lobe is substantially semi-circular.

13. The apparatus of claim 8 wherein each lobed cam includes a plurality of lobes, in which each lobe has a lobe center line and a first counterclockwise cam inner surface on one side of the lobe center line and a first clockwise cam inner surface on the opposite side of the lobe center line.

14. The apparatus of claim 8 wherein the enclosed channel is configured to interface with a rotary tool that can oscillate between applying a counterclockwise force and a clockwise force.

15. The apparatus of claim 8 wherein the first cage terminus and the second cage terminus are tapered.

16. An apparatus for removing at least two nuts, the apparatus comprising:

a housing, the housing includes, a top surface-having a first orifice that extends to a first lip;

a first interior side wall that extends from the top surface to the first lip, wherein the first-interior sidewall includes, a first three-lobed cam disposed along the first interior sidewall, wherein each lobe has a lobe center line and a first counterclockwise cam inner surface on one side of the lobe center line and a first clockwise cam inner surface on the opposite side of the lobe center line, a first groove disposed between the top surface and the first lip;

a first enclosed channel that extends between the first lip and a second lip;

a bottom surface having a second orifice that extends to the second lip;

a second interior sidewall that extends from the bottom surface to the second lip wherein the second interior sidewall includes, a second three-lobed cam disposed along the second interior sidewall, wherein each lobe has a lobe center line and a second counterclockwise cam inner surface on one side of the lobe center line and a second clockwise cam inner surface on the opposite side of the lobe center line, a second groove disposed between the bottom surface and the second lip;

a first cage having a first cage top surface and a first cage bottom portion, the first cage bottom portion includes a first cage groove and a first cage terminus, the first cage groove disposed between the first cage top surface and the first cage terminus, the first cage includes a plurality of jaws in which each jaw includes, a first jaw outer cam surface that is configured to interface with the cam inner surface corresponding to the first interior sidewall;

a first jaw centerline;

a first jaw inner cam surface configured to interlace with the head of a first nut, each first jaw cam inner surface includes a first jaw counterclockwise cam inner surface on one side of the jaw centerline and a first jaw clockwise cam inner surface on the opposite side of the jaw centerline;

a first earned coil spring configured to be received by the groove of the first inferior sidewall and the groove of the first cage;

a second cage having a second cage top surface and a second cage bottom portion, the second cage bottom portion includes a second cage groove and a second cage terminus, the second cage groove disposed between the second cage top surface and the second cage terminus, the second cage includes a plurality of jaws in which each jaw includes, a second jaw outer cam surface that is configured to interface with the cam inner surface corresponding to the second interior sidewall;

a second jaw centerline;

a second jaw inner cam surface configured to interface with the bead of a second nut, each second jaw cam inner surface includes a second jaw counterclockwise cam inner surface on one side of the jaw centerline and a second jaw clockwise cam inner surface on the opposite side of the jaw centerline;

a second canted coil spring configured to be received by the groove of the second interior sidewall and the groove of the second cage;

the first cage configured to rotate counterclockwise and engage the first nut, the first cage configured to interface with the first interior sidewall;

the second cage configured to rotate counterclockwise and engage the second nut, the second cage configured to interface with the second interior sidewall; and the first canted coil spring configured to operate within a constant deflection range when an axial load is applied by the housing and the first cage, the second canted coil spring configured to operate within a constant deflection range, when an axial load is applied by the housing and the second cage.

17. The apparatus of claim 16 wherein the lobe centerlines for each lobe are 120° apart, each lobe occupies a 120° arc, the counterclockwise cam interface has a 60° arc and the clockwise cam interface has a 60° arc.

18. The apparatus of claim 16 wherein each lobe is substantially semi-circular.

19. The apparatus of claim 16 wherein each first jaw outer cam surface occupies a 60° arc.

20. The apparatus of claim 16 further comprising an elastomeric component configured to join the plurality of jaws.

* * * * *